US006102108A

United States Patent [19]

Sillince

[11] Patent Number: 6,102,108

[45] Date of Patent: Aug. 15, 2000

[54] HEAT EXCHANGE UNIT HAVING THERMALLY CONDUCTIVE DISCS HAVING PREFERENTIAL FLOW PATHS

[75] Inventor: Mark Sillince, Eaton Bray Dunstable, United Kingdom

[73] Assignee: Chill-Can International, Inc., Laguna Niguel, Calif.

[21] Appl. No.: 09/237,873

[22] Filed: Jan. 27, 1999

[51] Int. Cl.[7] ..... F28D 27/02

[52] U.S. Cl. ..... 165/104.12; 165/47; 62/293; 62/294; 62/457.9

[58] Field of Search ..... 165/104.12, 918; 62/457.9, 476, 294, 293

[56] References Cited

U.S. PATENT DOCUMENTS

| | | | |
|---|---|---|---|
| 2,460,765 | 2/1949 | Palaith | 62/457.9 |
| 3,338,067 | 8/1967 | Warner | 62/457.9 |
| 3,373,581 | 3/1968 | Strader | 62/457.9 |
| 3,417,573 | 12/1968 | Warner | 62/457.9 |
| 3,525,236 | 8/1970 | Solhkhah | 62/457.9 |
| 3,636,726 | 1/1972 | Rosenfeld et al. | 62/457.9 |
| 3,668,886 | 6/1972 | Hofer | 62/457.9 |
| 3,802,056 | 4/1974 | Jaeger | 62/457.9 |
| 4,640,102 | 2/1987 | Tenenbaum et al. | 62/457.9 |
| 4,679,407 | 7/1987 | Kim et al. | 62/457.9 |
| 4,688,395 | 8/1987 | Holcomb | 62/457.9 |
| 4,736,599 | 4/1988 | Siegel | 62/457.9 |
| 5,201,183 | 4/1993 | Ramos | 62/457.9 |
| 5,214,933 | 6/1993 | Aitchison et al. | 62/457.9 |
| 5,447,039 | 9/1995 | Allison | 62/457.9 |

*Primary Examiner*—Ira S. Lazarus
*Assistant Examiner*—Terrell McKinnon
*Attorney, Agent, or Firm*—Fulbright & Jaworski L.L.P.

[57] ABSTRACT

A heat exchange unit and a beverage or food container including a heat exchange unit therein. The heat exchange unit includes a vessel having a plurality of thermally conductive discs with a layer of compacted adsorbent material such as carbon particles disposed between adjacent discs. The periphery of the discs are in thermally conductive contact with the inner surface of the vessel and each discs has at least one surface which defines a plurality of radially extending grooves terminating at the periphery to define a preferential flow path for gas under pressure to travel along the inner surface of the vessel wall. The periphery of the discs also define a plurality of notches, one at each groove terminal, to enhance the preferential flow path.

12 Claims, 2 Drawing Sheets

HEAT EXCHANGE UNIT HAVING THERMALLY CONDUCTIVE DISCS HAVING PREFERENTIAL FLOW PATHS

FIELD OF THE INVENTION

The present invention relates generally to a heat exchange unit for use in containers for self-chilling foods or beverages and more particularly to a heat exchange unit of the type in which temperature reduction is caused by the desorption of a gas from an adsorbent disposed within the heat exchange unit.

DESCRIPTION OF THE ART

Many foods or beverages available in portable containers are preferably consumed when they are chilled. For example, carbonated soft drinks, fruit drinks, beer, puddings, cottage cheese and the like are preferably consumed at temperatures varying between 33° Fahrenheit and 50° Fahrenheit. When the convenience of refrigerators or ice is not available such as when fishing, camping or the like, the task of cooling these foods or beverages prior to consumption is made more difficult and in such circumstances it is highly desirable to have a method for rapidly cooling the content of the containers prior to consumption. Thus a self-cooling container, that is, one not requiring external low temperature conditions is desirable.

The art is replete with container designs which incorporate a coolant capable of cooling the contents without exposure to the external low temperature conditions. The vast majority of these containers incorporate or otherwise utilize refrigerant gases which upon release or activation absorb heat in order to cool the contents of the container. Other techniques have recognized the use of endothermic chemical reactions as a mechanism to absorb heat and thereby cool the contents of the container. Examples of such endothermic chemical reaction devices are those disclosed in U.S. Pat. Nos. 1,897,723, 2,746,265, 2,882,691 and 4,802,343.

Typical of devices which utilize gaseous refrigerants are those disclosed in U.S. Pat. Nos. 2,460,765, 3,373,581, 3,636,726, 3,726,106, 4,584,848, 4,656,838, 4,784,678, 5,214,933, 5,285,812, 5,325,680, 5,331,817, 5,606,866, 5,692,381 and 5,692,391. In many instances the refrigerant gas utilized in a structure such as those shown in the foregoing U.S. Patents do not function to lower the temperature properly or if they do, they contain a refrigerant gaseous material which may contribute to the greenhouse effect and thus is not friendly to the environment.

To solve problems such as those set forth above in the prior art applicant is utilizing as a part of the present invention an adsorbent desorbent system which may comprise adsorbent materials such as zeolites, cation zeolites, silicagel, activated carbons, carbon molecular sieves and the like. Preferably the present invention utilizes activated carbon which functions as an adsorbent for carbon dioxide. A system of this type is disclosed in U.S. Pat. No. 5,692,381 which is incorporated herein by reference.

In these devices the adsorbent material is disposed within a vessel, the outer surface of which is in thermal contact with the food or beverage to be cooled. Typically, the vessel is disposed within and may be connected to an outer container which receives the food or beverage to be cooled in such a manner that it is in thermal contact with the outer surface of the vessel containing the adsorbent material. This vessel of the heat exchange unit is affixed to the outer container typically to the bottom thereof and contains a valve or similar mechanism which functions to release a quantity of gas, such as carbon dioxide which has been adsorbed by the adsorbent material contained within the inner vessel. When opened the gas such as carbon dioxide is desorbed and the endothermic process of desorption of the gas from the activated carbon adsorbent causes a reduction in the temperature of the food or beverage which is in thermal contact with the outer surface of the inner vessel thereby lowering the temperature of the food or beverage contained therein.

To accomplish this cooling it is imperative that as much carbon dioxide be adsorbed onto the carbon particles contained within the inner vessel and further that the thermal energy contained within the food or beverage be transferred therefrom through the wall of the inner vessel and through the adsorbent material to be carried out of the heat exchange unit along with the desorbed carbon dioxide. It is known in the art that most adsorbents are poor conductors of thermal energy. For example, activated carbon can be described as an amorphic material and consequently has a low thermal conductivity. By compacting the activated carbon to the maximum amount while still permitting maximum adsorption of the carbon dioxide gas thereon does assist some in conduction of thermal energy. However, sufficient thermal energy conduction is not accomplished simply by the compaction of the carbon particles. To allow better heat transfer of the heat contained in the food or beverage it is necessary to incorporate heat transfer means which will assist in conducting heat from the surface of the inner vessel through the carbon particles disposed within the inner vessel to be carried out with the desorbed carbon dioxide gas as it leaves the heat exchange unit.

As above pointed out one of the problems with conventional arrangements utilizing adsorbent desorbent systems is that the flow of desorbed gas does not efficiently remove the heat from the food or beverage in contact with the outer surface of the heat exchange unit. Although part of the desorbed gas leaves the adsorbent adjacent the nearest wall and then travels along the vessel wall to the exit valve, a significant portion also permeates through the adsorbent, and through the exit valve of the vessel without coming into contact with the vessel wall and thus a significant amount of the potential cooling capability of the desorbed gas is effectively wasted. Also, as above pointed out, it is important that the adsorbent, such as the activated carbon particles be compacted as highly as possible without substantially reducing the porosity of the body of absorbent to such a degree that its capability of adsorbing the carbon dioxide gas or the retardation of the rate of desorption from within the body of the absorbent is not deleteriously affected.

SUMMARY OF INVENTION

A heat exchange unit for use in a container for chilling a food or beverage contained therein. The heat exchange unit includes a thermally conductive vessel having a wall. An adsorbent material is received within the vessel for adsorbing a quantity of gas under pressure. A plurality of spaced apart discs having the adsorbent material therebetween and in contact therewith are disposed within the vessel. The discs are constructed of a thermally conductive material and each includes a periphery which is in heat transfer contact with the wall of the vessel. Each of the discs includes first and second outer surfaces with at least one of the outer surfaces defining a plurality of grooves terminating at the periphery of the disc for conducting desorbed gas to the wall of said vessel.

DETAILED DESCRIPTION

Figure 1:
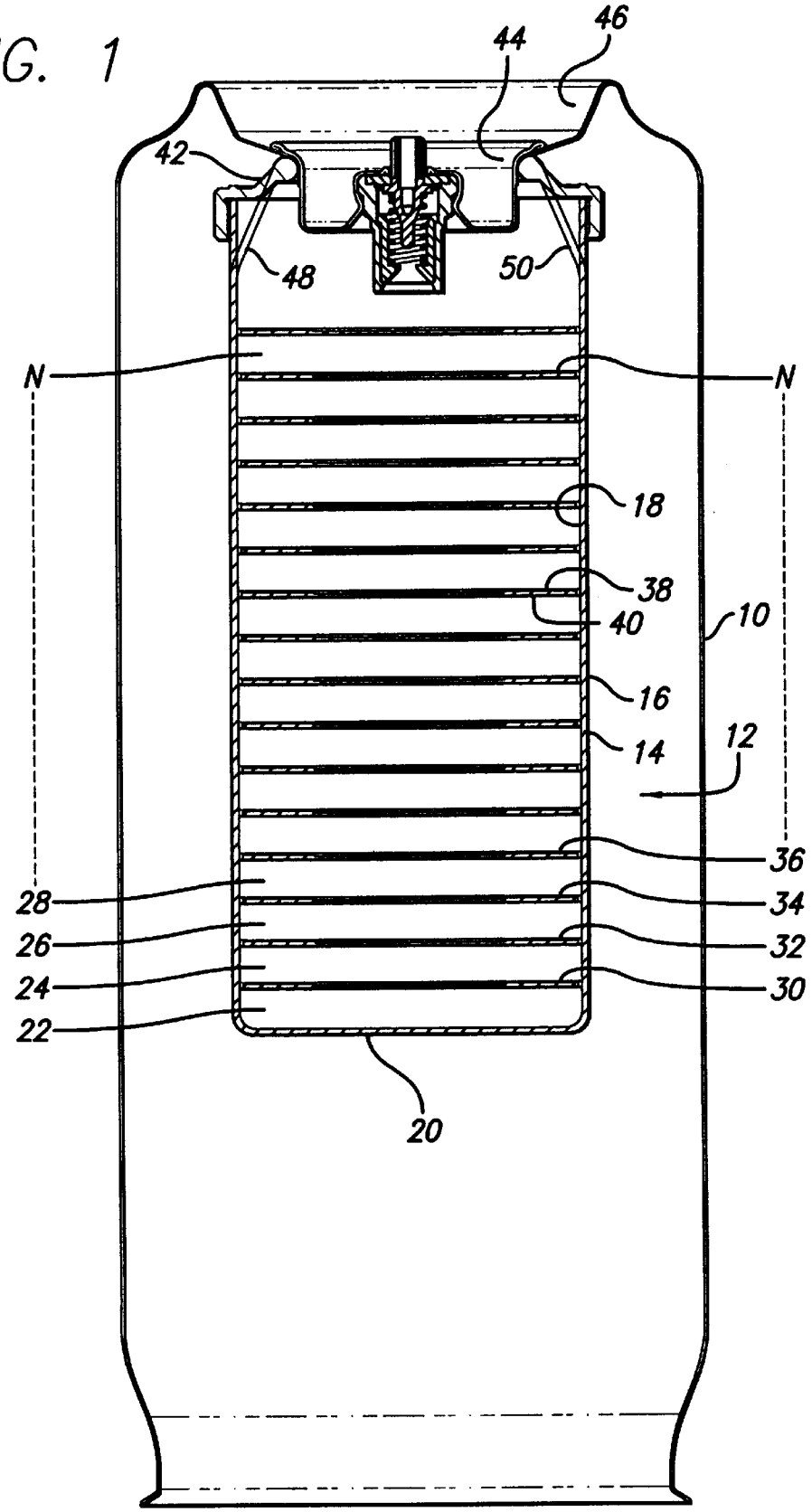
FIG. 1 is a cross-sectional view illustrating a heat exchange unit constructed in accordance with the principles of the present invention assembled with a beverage can.

Although, as above indicated, the present invention is equally applicable to containers housing food or beverage, for purposes of ease of illustration and clarity of description, the following description will be given in conjunction with the illustration of a beverage can having a heat exchange unit constructed in accordance with the principles of the present invention attached to the bottom thereof. This should not be taken as a limitation upon the scope of the present invention. The key factor is that the heat exchange unit of the present invention includes a thin walled vessel which is placed in thermal contact with the food or beverage to be chilled and contains an adsorbent for receiving and adsorbing under pressure a quantity of gas. The desorption of the gas and its passage along the vessel wall causes a reduction in the temperature of the food or beverage which is in contact with the thin walled vessel of the heat exchange unit. The heat from the food or beverage assists in effecting desorption of the gas. The heat exchange unit includes a plurality of heat transfer elements in contact with the wall of the vessel forming the heat exchange unit. Each of the heat transfer elements provides preferential pathways for the desorbed gas to travel from the adsorbent material to the vessel walls so that the gas can travel along the walls of the vessel before leaving the vessel. This enhances the heat transferability of the heat exchange unit and accelerates the chilling process for the food or beverage contained within the container. Preferably each of the heat transfer elements is of the same shape and are arranged so as to be placed in contact with the adsorbent material placed immediately therebelow within the vessel. The heat transfer elements also assist in compacting or compressing the adsorbent material contained within the vessel.

In a preferred embodiment of the heat exchange unit constructed in accordance with the present invention the heat transfer elements are disc shaped with an outer periphery which contacts the inner surface of the wall of the vessel forming the heat exchange unit. In construction of the heat exchange unit a layer of activated carbon particles is introduced into the empty vessel and a heat transfer element disc is placed into the vessel on top of the layer of activated carbon particles then an additional layer of carbon is placed on top of this disc which is then followed by a second disc. This is continued until the vessel is filled with layers of activated carbon particles with a heat transfer element disposed between adjacent layers in such a manner that it is in contact with the top surface of the layer below it and the lower surface of the layer of carbon particles immediately above it. One of the outer surfaces of each of the discs defines a plurality of grooves which terminate at the periphery of the disc. Pressure is applied to the stack of discs and carbon particles by an appropriate fixture to thereby compact the activated carbon particles to a preferred density to maximize the amount of gas under pressure which may be adsorbed by the carbon particles. If desired, pressure may be applied as each of the heat transfer discs is placed within the vessel on top of the underlying layer of carbon particles. The periphery of each of the discs engages the inner surface of the wall of the heat exchange unit in an interference fit and thus by such friction is held in place and assists in maintaining compaction of the carbon particles disposed therebeneath.

Referring now to the drawings there is illustrated a beverage container 10 having disposed therein a heat exchange unit 12 constructed in accordance with the principles of the present invention. The heat exchange unit 12 includes a thin walled vessel 14 which includes an outer surface 16 and an inner surface 18. Preferably the vessel 14 is cylindrical in configuration and includes a closed bottom 20. Disposed within the vessel 14 is a plurality of layers of adsorbent material 22, 24, 26, 28 - - - N preferably comprising activated carbon particles. By utilization of the designation N it should be understood that there may be any number of layers of adsorbent material which may be desired depending upon the size of the heat exchange unit 12 and the amount of food or beverage contained within the outer container 10 to be chilled. Also disposed within the vessel 16 is a plurality of heat transfer elements 30, 32, 34, 36 - - - N; also indicating that there may be any number of such heat transfer elements desired again, depending upon the structure of the heat exchange unit 12. Preferably each of the heat transfer elements is a disc which has an outer periphery which is in thermally conductive contact with the inner surface 18 of the vessel 14. As will be seen by reference to FIG. 1, except for the uppermost heat transfer element, each of the elements includes a first surface such as shown at 38 and a second surface such as shown at 40 with the first or upper surface 38 in contact with the layer of adsorbent material disposed above it while the second surface 40 is in contact with the layer of activated carbon adsorbent material disposed below. There is no adsorbent material above the upper surface of the uppermost heat transfer element. As above discussed the construction of the heat exchange unit 12 may be accomplished by placing the layer 22 of adsorbent material in the bottom of the vessel 14 so that it is in contact with the bottom wall 20. The heat transfer element 30 is then placed in position so that the periphery thereof is in contact with the inner surface 18. If desired, pressure may be applied to the heat transfer element 30 thereby compacting the layer 22 of adsorbent material to the desired density. The outer periphery of the element 30 contacts the inner surface 18 of the vessel 16 in an interference fit and thereby retains the adsorbent material compacted when pressure is removed therefrom. An additional layer 24 of adsorbent material is then placed within the vessel 14 and a heat transfer element 32 placed thereon and, if desired, compaction pressure applied as above described. This process will be continued until the uppermost heat transfer element N has been positioned and appropriate pressure applied. After the vessel 14 has been appropriately filled with the activated carbon and the heat transfer elements, a cap such as shown at 42 may be placed thereon and an appropriate valve mechanism 44 inserted within an opening provided in the bottom 46 of the beverage can 10 with the combination crimped to hold the valve mechanism 44 and the heat exchange unit 12 in place in the bottom of the beverage can 10. Alternatively, as shown by the dashed lines 48 and 50, once the layers of activated carbon and heat transfer elements are disposed within the vessel 16 the upper extension thereof maybe formed inwardly and curled over at its periphery to mate with the valve mechanism. Also, in the event the discs are not structured to attain an interference fit with the wall 18, such inward forming will retain the compaction of the activated carbon particles disposed between the heat transfer elements. When such is done the vessel 14 is a one piece vessel and the cap 42 may be eliminated with the vessel containing the adsorbent material and the thermally conductive discs secured directly to the bottom of the can by appropriate crimping.

Figure 2:
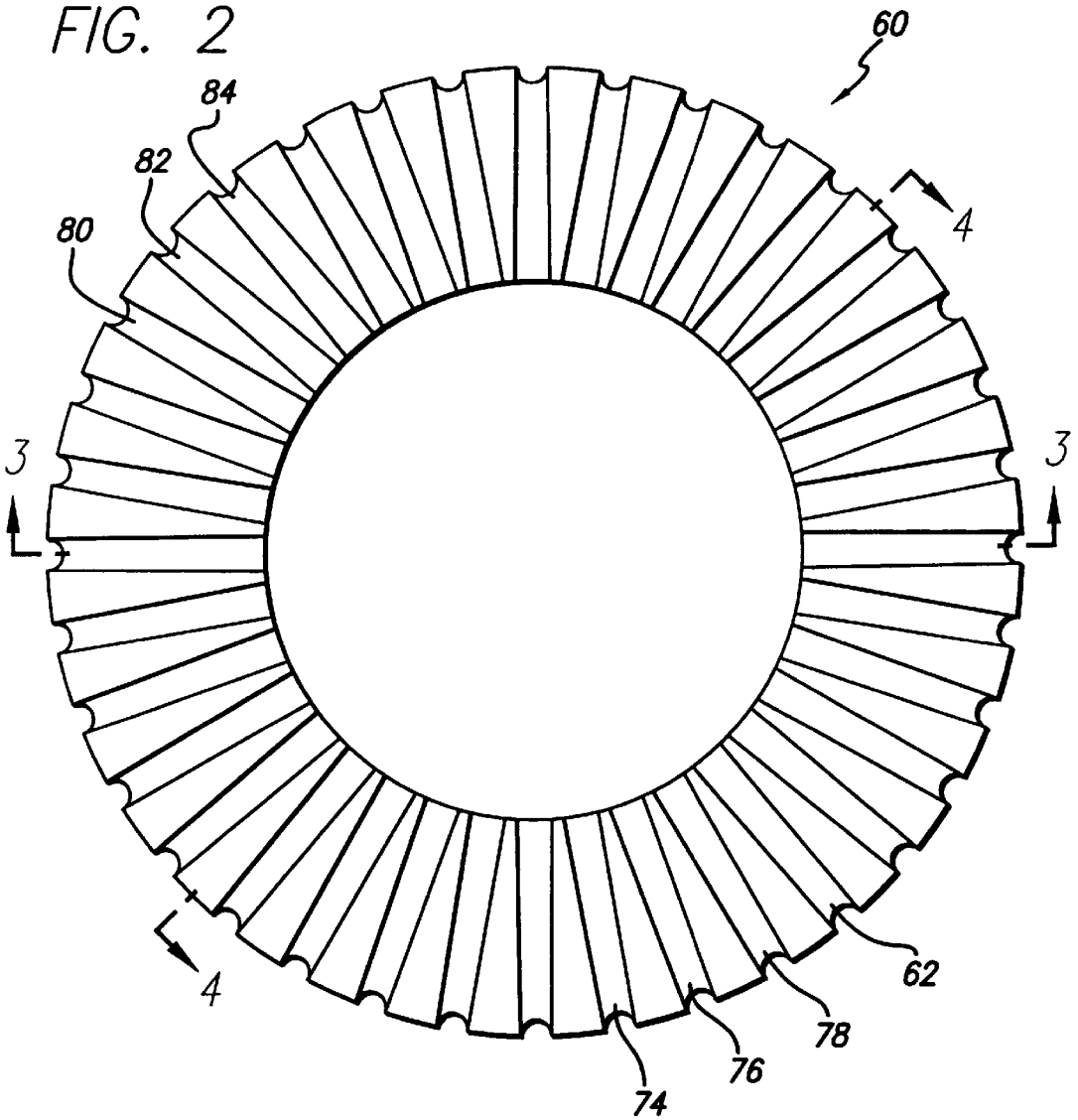
FIG. 2 is a top plan view of a disc utilized in the heat exchange unit of the present invention.
Figure 3:
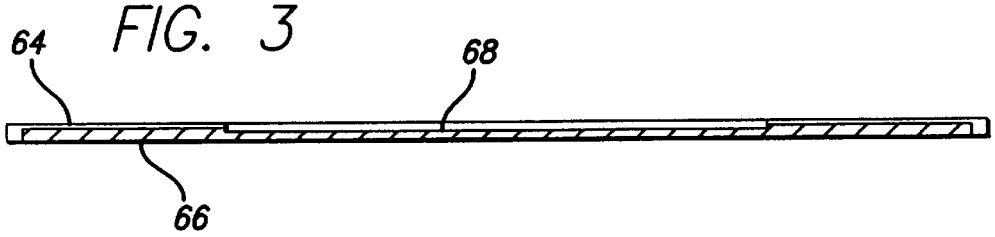
FIG. 3 is a cross-sectional view of the disc FIG. 2 taken above the lines 3—3 of FIG. 2.
Figure 4:
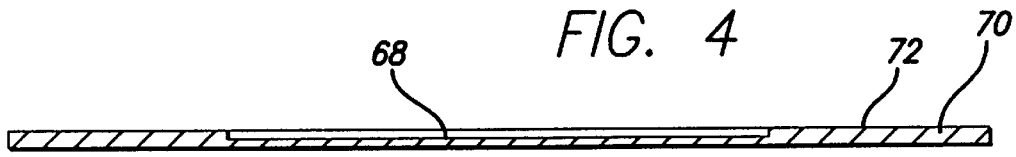
FIG. 4 is a cross-sectional view of the disc of FIG. 2 above the lines 4—4 of FIG. 2.

By referring now more particularly to FIGS. 2–4 there is illustrated in greater detail a heat transfer element 60 constructed in accordance with the present invention. The heat transfer element 60 is preferably disc shaped and includes a periphery 62 and a first or upper layer or surface 64 and a second or lower layer or surface 66. If desired, the central portion of the disc 60 may define a reduced thickness area or dished out portion 68. Such a structure provides an annular outer portion 70 to the disc 60. The upper surface 72 of this annular portion 70 has provided therein a plurality of grooves, three of which are shown at 74, 76 and 78. Preferably, these grooves are equi-angularly spaced around the annular portion 70 of the disc 60. The grooves 74, 76, 78 terminate at the periphery 62 of the disc 60 and also communicate with the depressed or dished out portion 68 formed in the disk. If desired, grooves may also be provided on the other surface of the member portion 70 to thereby provide a preferential flow path on each side of each disc. Under such circumstance, the opposite side of disc 60 in FIG. 2, would be mirror image of the illustration of FIG. 2.

It should also be noted, particularly in FIG. 2 that the outer periphery 62 of the disc 60 has a plurality of notches 80, 82 and 84 formed therein. Each of the notches 80, 82 and 84 are disposed at the outer terminus of one of the grooves which are formed in the upper surface 72 of the annular portion 70 of the disc 60. The notches 80, 82 and 84 are thus also equiangularly disposed about the periphery 62 of the disc 60 and extend between the upper and lower surfaces 64 and 66 of the disc 60.

From the foregoing description it should now be recognized that when the heat transfer elements 30, 32, 34, 36 - - - N are positioned in place with the activated carbon particle layers 22, 24, 26, 28 - - - N disposed and compacted therebetween there is provided a preferential flow path for pressurized gas such as carbon dioxide to enter the heat exchange unit and thereby charge it by adsorbing the gas such as carbon dioxide to the carbon particles. Likewise, upon release through the valve mechanism 44 the pressurized gas upon desorption can leave the heat exchange unit. As the adsorbed gas is permitted to desorb it should be noted that the gas will travel along the preferential flow passageways which are closed by the inner surface 18 of the vessel 16. The grooves 74, 76, 78 which communicate with the notches provide a preferential path for the desorbed gas (or alternatively charging the gas traveling into the carbon particles for adsorption) so that the gas may travel along the notches formed adjacent the inner surface 18 and through the grooves formed on the disc upper surface thereby providing a greater ability for the desorbed gas to leave the interior portion of the compacted carbon particles and to travel outwardly and into contact with the inner surface 18 of the vessel 16. Through the utilization of a solid metallic disc it should be noted that none of the desorbed gases may travel upwardly and out through the valve mechanism 44 without traveling through the notches 80, 82, 84 and along the inner surface 18 of the vessel 14. Thus, the heat transfer capability of the heat exchange unit is enhanced.

There has thus been disclosed a heat exchange unit for use in containers housing food or beverage for the in site cooling of the food or beverage through the utilization of an adsorption/desorption system. The heat exchange unit includes a plurality of heat transfer elements interposed between layers of adsorbent material such as activated carbon. By activation of a valve a gas under pressure adsorbed onto the carbon particles within the heat exchange unit is caused to desorb and travel through preferential flow paths defined by grooves on the surfaces of the heat exchange elements and then along notches formed in the outer periphery thereof to force the desorbed gas to travel along the inner surface of the wall which defines the heat exchange unit.

What is claimed is:

1. A heat exchange unit for use in a container for chilling a food or beverage contained therein comprising:

(a) a thermally conductive vessel having a wall;

(b) an adsorbent material received within said vessel for adsorbing a quantity of gas under pressure;

(c) a plurality of spaced apart discs formed of thermally conductive material and having a periphery in heat transfer contact with said wall of said vessel, said adsorbent material being disposed between and in contact with said discs, each of said discs having first and second outer surfaces, at least one of said outer surfaces includes a plurality of grooves defining a preferential flow path terminating at said periphery for conducting desorbed gas to said wall.

2. A heat exchange unit as defined in claim 1 which further includes a plurality of notches formed in said periphery of each of said discs.

3. A heat exchange unit as defined in claim 2 wherein each of said notches is disposed on the periphery of said disc at a terminus of a groove.

4. A heat exchange unit as defined in claim 3 wherein at least one of said outer surfaces also defines a centrally disposed recess therein and wherein each of said grooves communicate between said recess and one of said notches.

5. The heat exchange unit as defined in claim 2 wherein each of said discs is constructed of a solid material which extends across the interior of said thermally conductive vessel with the only egress from said vessel for desorbed gases contained therein is along said preferential flow path.

6. The heat exchange unit as defined in claim 5 wherein each of said discs is circular and is formed of a metallic material.

7. A self chilling food or beverage container comprising:

(a) an outer container for containing said food or beverage and a heat exchange unit affixed to said outer container, said heat exchange unit comprising:

1. a thermally conductive vessel having a wall;
2. an adsorbent material received within said vessel for adsorbing a quantity of gas under pressure;
3. a plurality of spaced apart discs formed of thermally conductive material and having a periphery in heat transfer contact with said wall of said vessel, said adsorbent material being disposed between and in contact with said discs, each of said discs having first and second outer surfaces, at least one of said outer surfaces includes a plurality of grooves defining a preferential flow path terminating at said periphery for conducting desorbed gas to said wall.

8. A heat exchange unit as defined in claim 7 which further includes a plurality of notches formed in said periphery of each of said discs.

9. A heat exchange unit as defined in claim 8 wherein each of said notches is disposed on the periphery of said disc at a terminus of a groove.

10. A heat exchange unit as defined in claim 9 wherein at least one of said outer surfaces also defines a centrally disposed recess therein and wherein each of said grooves communicate between said recess and one of said notches.

11. The heat exchange unit as defined in claim 8 wherein each of said discs is constructed of a solid material which extends across the interior of said thermally conductive vessel with the only egress from said vessel for desorbed gases contained therein is along said preferential flow path.

12. The heat exchange unit as defined in claim 11 wherein each of said discs is circular and is formed of a metallic material.

* * * * *